United States Patent [19]

Kimoto

[11] Patent Number: 4,668,028

[45] Date of Patent: May 26, 1987

[54] REFRIGERATED STORAGE CABINET

[75] Inventor: Yasuhito Kimoto, Kamiuekihon, Japan

[73] Assignee: Sanden Corporation, Gunma, Japan

[21] Appl. No.: 731,017

[22] Filed: May 6, 1985

[30] Foreign Application Priority Data

May 8, 1984 [JP] Japan ..... 59-67562[U]

[51] Int. Cl.[4] ..... A47F 3/04

[52] U.S. Cl. ..... 312/116; 62/252; 312/214

[58] Field of Search ..... 62/246, 247, 248, 249, 62/250, 252, 253, 254, 255; 312/116, 296, 214, 257 A

[56] References Cited

U.S. PATENT DOCUMENTS

| | | | |
|---|---|---|---|
| 2,299,347 | 10/1942 | Rifkin | 312/116 X |
| 2,450,088 | 9/1948 | Henderson | 62/254 X |
| 2,671,001 | 3/1954 | Ossanna, Jr. | 62/255 X |
| 2,794,325 | 6/1957 | Shearer | 312/116 X |
| 2,896,423 | 7/1959 | Pettinato | 62/255 X |
| 2,961,845 | 11/1960 | Kennedy | 62/254 X |
| 3,046,757 | 7/1962 | Bank | 62/253 X |
| 3,204,421 | 9/1965 | Jirel | 62/252 X |
| 3,245,740 | 4/1966 | Spielman | 312/213 |
| 4,109,984 | 8/1978 | Gandara | 312/116 X |
| 4,320,933 | 3/1982 | Felix et al. | 312/257 A X |

FOREIGN PATENT DOCUMENTS

| | | | |
|---|---|---|---|
| 1294396 | 12/1962 | France | 312/116 |

*Primary Examiner*—Kenneth J. Dorner
*Assistant Examiner*—Thomas A. Rendos
*Attorney, Agent, or Firm*—Banner, Birch, McKie & Beckett

[57] ABSTRACT

A refrigerated storage cabinet suitable for use in convenient storing of food stuffs has a plurality of storage chambers within which storage racks are located and the temperature maintained by a refrigerating unit. One opening of each of the storage chambers is covered by a door element which is provided to function as the door for a display case or for a vending machine whereby different forms of merchandise can be stored in the cabinet and vending sales made from the same cabinet.

1 Claim, 3 Drawing Figures

REFRIGERATED STORAGE CABINET

BACKGROUND OF THE INVENTION

This invention relates to a storage cabinet for beverage and food stuffs, and more particularly, to a display and vending cabinet suitable use for store establishments.

Generally, beverages and/or food stuffs are stored in a display/storage case or in a vending machine for selling these goods. Thus, any stored goods selectively either use the display/storage case or the vending machine which is adapted to the selling form of the merchandise or to the natural storage shape of the food stuffs or beverages.

For example, as shown in FIG. 3, each display/storage case 100 and vending machine 200 requires an individual cabinet housing 110 or 210 and separate refrigerating unit 120 or 220 to maintain the predetermined temperature in the storage chambers 111 and 211. These separate housings 110 and 210 are placed along the wall 30 of the store establishment area or set back to back with one another, as shown in FIG. 3. Therefore, the storage requirements call for the need for both display/storage cases and vending machines such that space to accommodate this equipment become worsened. Further, large energy input is required to maintain the temperature in the separate storage chambers of this equipment. Also, each display/storage case and vending machine must be purchased separately. Therefore, the cost to acquire the equipment is substantial.

SUMMARY OF THE INVENTION

It is a primary object of this invention to provide an improvement in a storage cabinet which has a plurality of storage chambers, each fitted with a door element and display rack elements are provided within one chamber for displaying and selling stored merchandise.

It is another object of this invention to provide a storage cabinet wherein a plurality of merchandise discharge devices and/or display racks are located within separate chambers of a single cabinet to improve the space factor for the equipment within a store establishment.

It is still another object of this invention to provide a storage cabinet having a plurality of forms of merchandise sales equipment wherein one refrigerating unit is utilized within the cabinet to reduce energy consumption.

A storage cabinet in accordance with the present invention includes a cabinet with openings at the front and rear sides thereof, and a door element disposed on each of the front and rear openings of the cabinet to cover the openings, respectively. The interior space of the cabinet is divided into at least two chambers which contain display racks or a vending device and each chamber has at least a front or rear opening from the cabinet. One of the door elements is movably supported on the cabinet and provided with clear see through window portion to display stored merchandise. The other door element is provided with a vending device delivery opening. Therefore, the chambers function as a display/storage case or a vending machine.

Further objects, features and other aspects of this invention will be understood from the following detailed description of a preferred embodiment of this invention referring to the annexed drawings.

DETAILED DESCRIPTION OF THE PREFERRED EMBODIMENT

Figure 1:
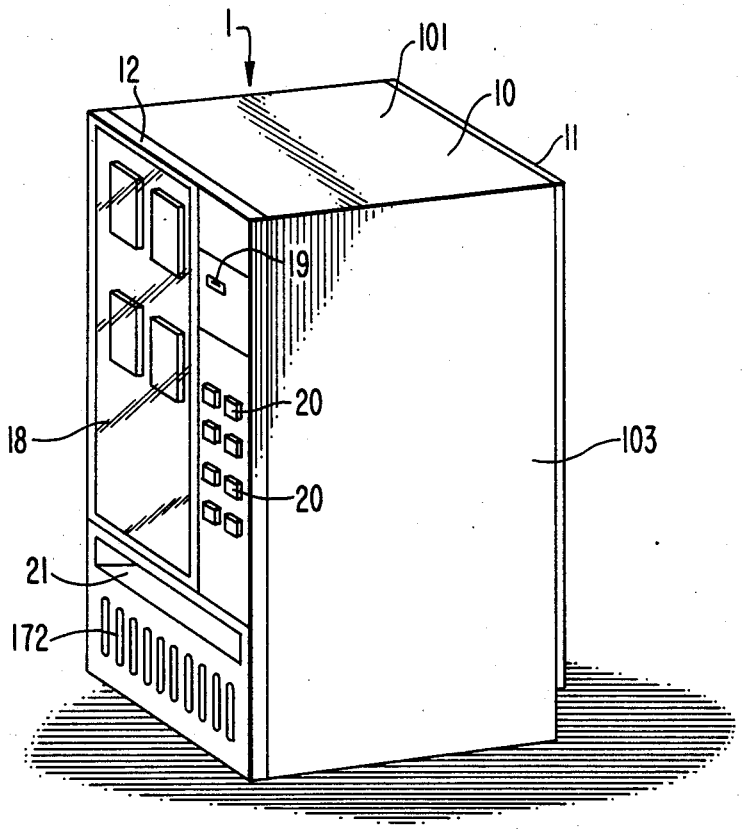
FIG. 1 is a perspective view of a storage cabinet in accordance with the present invention.
Figure 2:
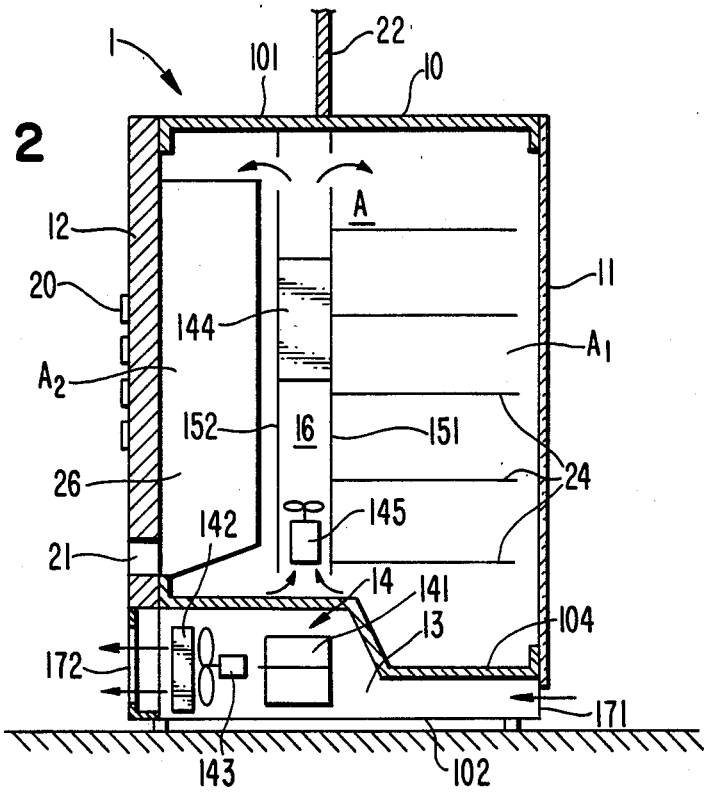
FIG. 2 is a cross-sectional view of the storage cabinet in FIG. 1.
Figure 3:
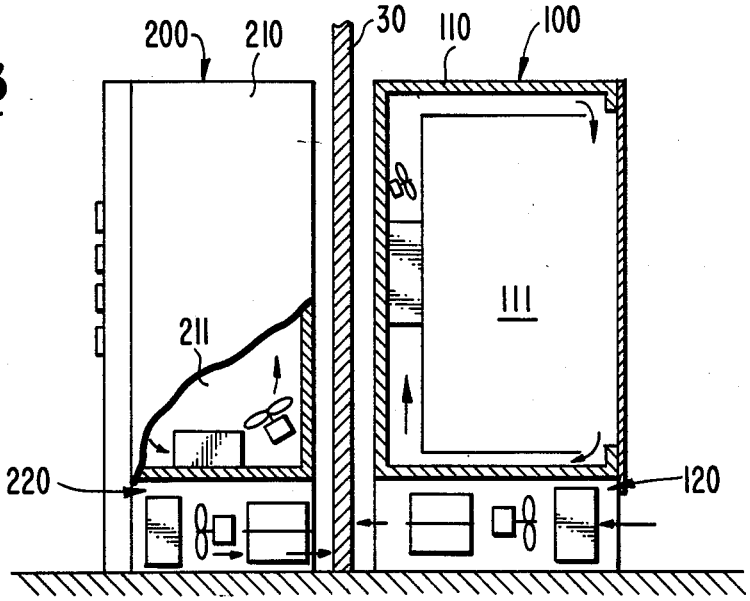
FIG. 3 PRIOR ART
FIG. 3 is a partial cross-sectional view of a prior art display case and vending machine illustrating a current form of equipment employed in a store establishment.

Referring to FIGS. 1 and 2, storage cabinet 1 in accordance with the present invention includes a cabinet 10 having a top panel 101, bottom panel 102 and two side panels 103 (in FIG. 1, only one side panel 103 is shown). Door elements 11 and 12 are disposed to close front and rear openings of cabinet 10.

A lower panel 104 is placed in the lower portion of cabinet 10 to define a bottom space 13 above panel 102 to house part of a refrigerating unit 14, such as a compressor 141, condenser 142 and blower motor 143. Two openings at the opposite ends of bottom space 13 are covered by slotted cover plates 171 and 172, respectively, these plates having a plurality of slits to accommodate air circulation within bottom space 13 circulated by blower motor 143 to cool the condenser 142. The interior space A of cabinet 10 is thus defined by top panel 101, lower panel 104, two side panels 103 and front and rear door elements 11 and 12.

As shown in FIG. 2, a pair of partition plates 151 and 152 are spaced from one another to define a gap 16, these plates being transversely disposed within the interior space A of cabinet 10 to divide space A into at least two chambers, such as front chamber $A_1$ and rear chamber $A_2$. The remainder of the refrigerating unit 14 including evaporator 144 and fan device 145 which causes forced convection within the interior space A are placed in the gap 16 between partition plates 151, 152. The upper and lower portions of each partition plate 151 and 152 are formed with openings to accommodate air flow circulation within chambers $A_1$ and $A_2$ of interior space A.

The opening of front chamber $A_1$ is closed by front door element 11 which consists of a transparent plate, element 11 being movably supported, as by means of hinges (not shown), on cabinet 10 to provide access to the interior of chamber $A_1$. Suitable display racks 24 are placed in the front chamber $A_1$. Racks 24 may be of the usual open wire grid type to allow free circulation of air through the racks and within chamber $A_1$. Therefore, the presence of merchandise stored in front chamber $A_1$ is easily confirmed from the outside of cabinet 10 by viewing the merchandise through the transparent door element 11 and access thereto is readily obtained by merely opening the front door element 11. Thus, front chamber $A_1$ functions as a storage/display case.

The opening of rear chamber $A_2$ is closed by rear door element 12 which carries a conventional vending mechanism 26 to use the door element 12 as a vending machine. Thus, door element 12 has a clear see through window portion 18 which displays the merchandise in rear chamber $A_2$, coin slot 19, selection switches 20 and merchandise delivery opening 21. Also, a plurality of merchandise storage rack elements within dispensing mechanism 26 are disposed within rear chamber $A_2$ to store and have dispensed therefrom the merchandise. Therefore, rear chamber $A_2$ functions as a vending machine. Thus, customers can shop for any of the merchandise stored in rear chamber $A_2$ by inserting the proper coin or coins in slot 19 and choosing one or another of the selection switches 20 of dispensing mechanism 26.

In the above mentioned construction of the invention, the storage cabinet 1 should be placed in an opening formed through a wall 22 of a store establishment so that each of the door elements faces into a different space area of the store. Then, the customers can shop for the different merchandise from both sides of the single cabinet 1. Also, the temperature in both of the chambers $A_1$ and $A_2$ is maintained at the predetermined degree by the operation of the one refrigerating unit 14. Therefore, the cost to the store establishment to place the single apparatus 1 in the store establishment will be reduced and the energy consumption to maintain the temperature in the storage chambers kept to a minimum.

The invention has been described in detail in connection with a preferred embodiment, but this is to be taken as an example only and the invention is not to be restricted thereto. It will be easily understood by those skilled in the art that other variations and modifications can be easily made within the scope of this invention as defined in the appended claims.

I claim:

1. A storage cabinet comprising a cabinet having a bottom panel dividing the same into a bottom space and an interior space and a partition dividing said interior space transversely into two storage chambers each having a door opening, said partition comprising a pair of plates extending transversely of said cabinet and spaced from one another to define a gap therebetween, said plates having openings adjacent the upper and lower portions thereof providing communication between the gap and the storage chambers for the circulation of air, means for storing merchandise in each of said storage chambers, a door element mounted to overlie each door opening to close the storage chambers, one of said door elements for one of said storage chambers being provided with a see-through window movably supported on said cabinet to display merchandise stored in the storage chamber and to provide access thereto, and the other of said door elements being provided with a vending device delivery opening to discharge merchandise stored in the other of said storage chambers, a fan mounted in the gap in the partition between said plates to force the circulation of air between the gap and the storage chambers through said openings and through the gap and the storage chambers, and refrigeration appartus for maintaining the temperature in said storage chambers including a compressor and a condenser mounted in said bottom space and an evaporator mounted in said gap for cooling air circulated through said gap by said fan.

* * * * *